United States Patent [19]

Hammel et al.

[11] 4,232,798

[45] Nov. 11, 1980

[54] AUTOMATIC VENDING MACHINE FOR DELIVERING CONTAINERS HAVING EDIBLE PRODUCT THEREIN

[75] Inventors: Richard L. Hammel, Lima; Robert H. Schaefer, Lakeview; Frederick N. Lancia, Columbus; William A. Wolfe, Pataskala; Leonard F. Dearth, Columbus; Stephen L. Benton, Gahanna; H. Richard Homan, Westerville; Arthur P. Bruce, Columbus, all of Ohio

[73] Assignee: The Kroger Company, Cincinnati, Ohio

[21] Appl. No.: 891,316

[22] Filed: Mar. 29, 1978

[51] Int. Cl.[3] ..... G07F 13/10

[52] U.S. Cl. ..... 221/12; 109/68; 141/83; 141/174; 177/112; 177/170; 177/230; 221/96; 221/220

[58] Field of Search ..... 221/12, 96, 113, 220; 141/174, 153, 83; 177/112, 114, 116, 170, 230; 53/502; 312/291; 109/68; 232/43.1–43.4

[56] References Cited

U.S. PATENT DOCUMENTS

| | | | |
|---|---|---|---|
| 2,580,257 | 12/1951 | Tacchella | 141/174 |
| 3,110,438 | 11/1963 | Leckner | 232/43.4 |
| 3,400,774 | 9/1968 | Cobb et al. | 177/170 X |
| 3,413,052 | 11/1968 | Schoenmakers | 221/220 X |
| 3,891,040 | 6/1975 | Schmitter | 177/230 |

FOREIGN PATENT DOCUMENTS

| | | | |
|---|---|---|---|
| 577269 | 6/1959 | Canada | 141/174 |

*Primary Examiner*—F. J. Bartuska

*Attorney, Agent, or Firm*—Cushman, Darby & Cushman

[57] ABSTRACT

An automatic vending machine for delivering soft ice cream or the like to ice cream cones or other containers. A pivotally mounted arm receives a cone and then moves to a product-dispensing station. The product is dispensed into the cone until a weight-responsive structure associated with the arm senses the predetermined weight of the product and stops delivery of the product to the cone. Then the arm is moved so that it deposits the cone in a delivery chamber and then is moved out of the delivery chamber back to a position to receive another cone. Mechanical latch structures are provided for latching the door to the delivery chamber in closed position until the arm has been completely withdrawn from the delivery chamber and a rod connects the arm to the latch for effecting unlatching of the door in response to movement of the arm so that the door is unlatched after the movement of the arm out of the delivery chamber. The door includes a structure for resetting the latch to latch the door after opening movement of the door and removal of the product-filled container from the delivery chamber so that the door is latched shut and remains latched until the next movement of the arm out of the delivery chamber after disposing a product-filled container therein.

16 Claims, 10 Drawing Figures

11
13
10
12A
14
77
12

61
55
D
63
54

Fig. 8
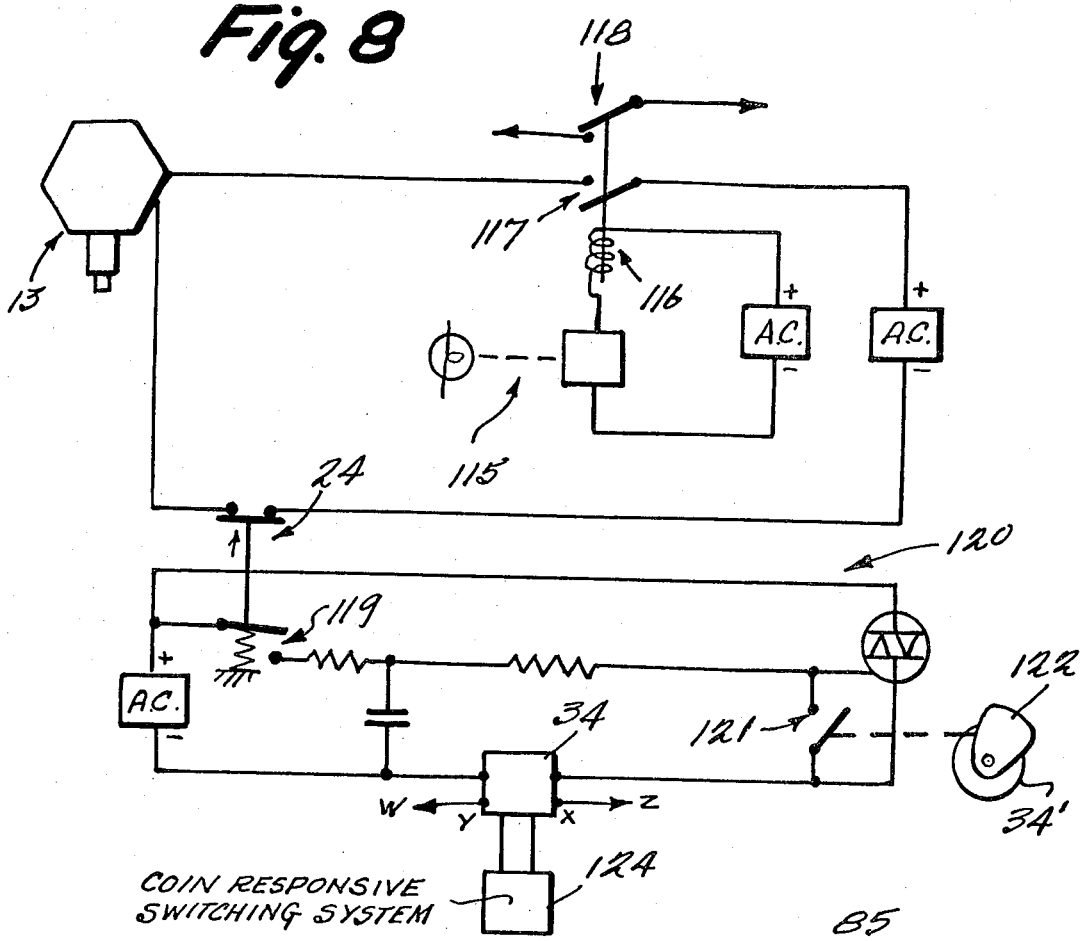
Fig. 9
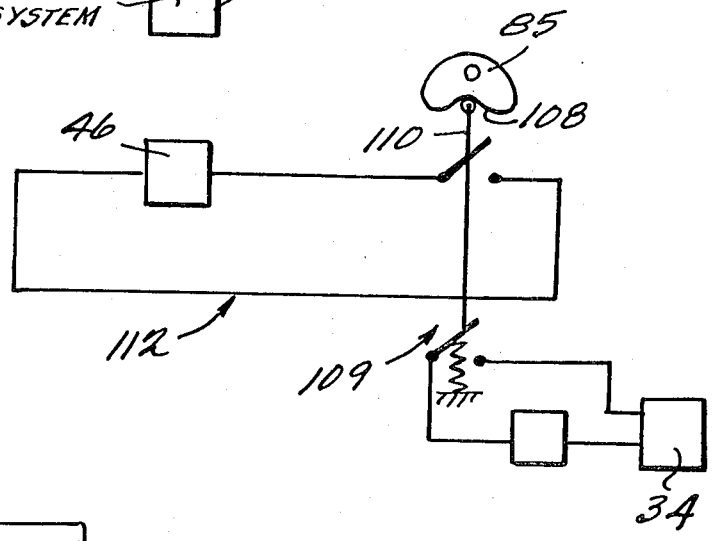
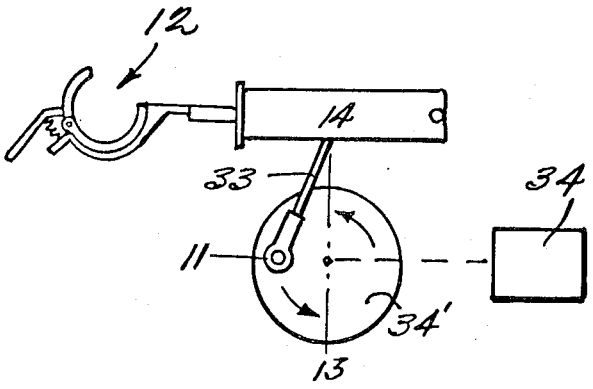
Fig. 10

AUTOMATIC VENDING MACHINE FOR DELIVERING CONTAINERS HAVING EDIBLE PRODUCT THEREIN

BACKGROUND AND SUMMARY OF THE INVENTION

U.S. Pat. No. 3,413,052 discloses a system that for the first time provides for practical automatic vending of ice cream cones and the like. The apparatus shown in U.S. Pat. No. 3,413,052 is capable of automatic vending of cones in a practical manner, however, many accessory problems with respect to automatic vending remain over the U.S. Pat. No. 3,413,052 structure. For instance, because of the special nature of the product being dispensed, it is difficult to provide a sensor at the dispensing head itself to determine when the predetermined amount of product has been delivered to the container for dispensing. This problem is complicated since the product being vended is under pressure during vending. According to the present invention, this problem has been overcome by pivotally mounting the container holding arm for rotation about a generally horizontal axis and providing product weight-responsive means associated with the arm for terminating delivery of products to a container being held by the arm after a predetermined weight of product has been delivered to the container.

The product weight-responsive means includes adjustable first spring means in engagement with the arm for pivoting the arm container-holding end in an upward direction about the horizontal axis, a microswitch and microswitch actuating means mounted to the arm and movable against the bias of the first spring means in response to product weight to actuate the microswitch. To negate the effects of the fact that the product being delivered is pressurized on the weight responsive means, a second spring means (also adjustable) is provided to biasing the arm for rotation about the horizontal axis in a direction opposite the direction in which the first spring biases the arm.

In the structure shown in U.S. Pat. No. 3,413,052 there also sometimes are problems associated with proper operation of the structure should an individual decide to open the door to the delivery chamber before depositing one's money. Such problems are overcome according to the present invention by providing a mechanical latch means for latching the access door to the delivery chamber in a closed position until the arm has been completely withdrawn from the delivery chamber, and then again latching the door shut once it has returned to its original position. Rod means operatively connect the arm to the latch means for effecting unlatching of the door in response to movement of the arm so that the door is unlatched by the rod means after movement of the arm out of the delivery chamber. The door includes means associated therewith for resetting the latching means to latch the door after opening movement thereof and removal of the container from the delivery chamber. A pneumatic door closer may be provided for slowly returning door to its original position so that injury to the customer may be avoided.

Also, according to the present invention, specific structures are provided for the rod means, latch means and resetting means which provide for a fail-safe, yet simple operation of the latch in a mechanical mode.

It is a primary object of the present invention to provide an improved automatic vending machine, especially adapted for vending soft ice cream in cones and the like. This and other objects of the invention will become clear from an inspection of the detailed description of the invention and from the appended claims.

BRIEF DESCRIPTION OF THE DRAWINGS

FIG. 8 is a schematic electrical control assembly for control of an automatic vending machine according to the invention;

FIG. 9 is an electrical schematic showing circuitry means for control of the cone dispensing drive of FIG. 6;

FIG. 10 is a schematic showing of the operation or movement of the cone holding arm during operation of the machine according to the invention.

DETAILED DESCRIPTION OF THE INVENTION

Figure 1:
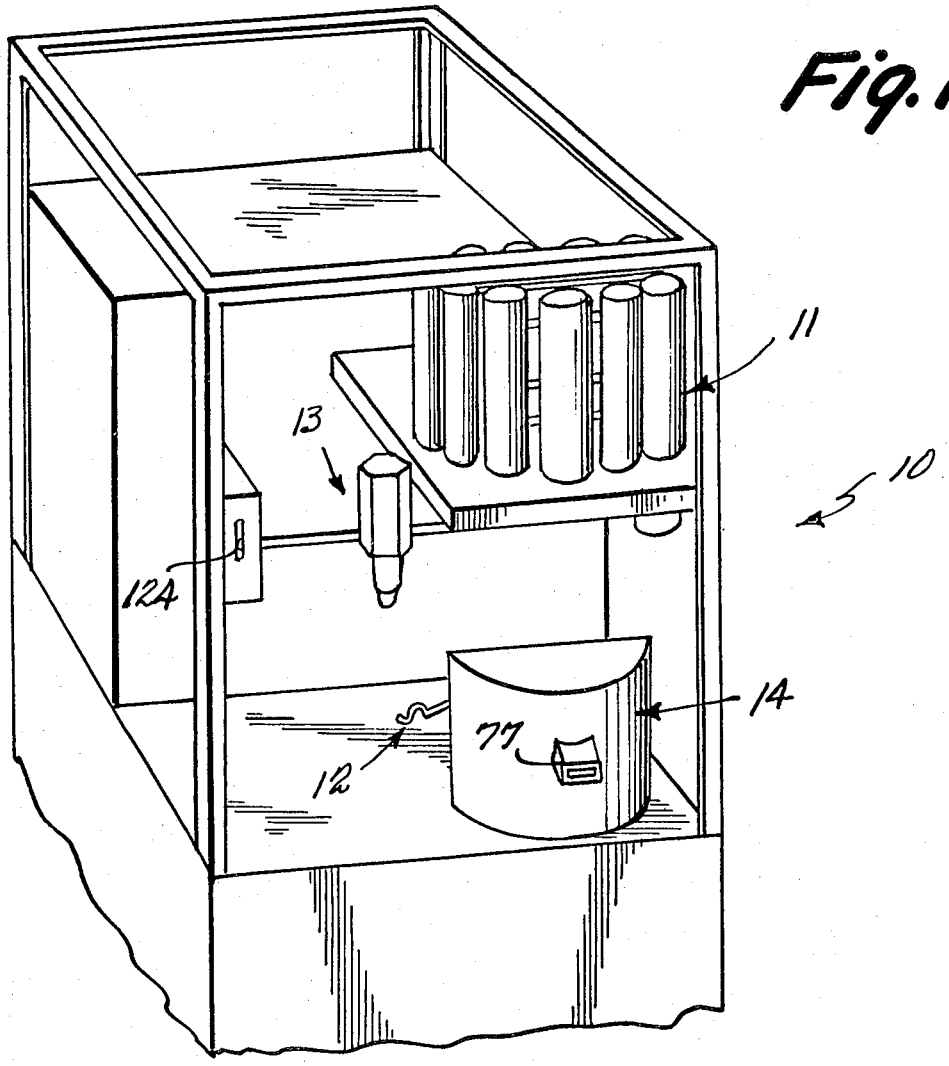
FIG. 1 is a schematic perspective view of an exemplary automatic venting machine according to the invention.
Figure 4:
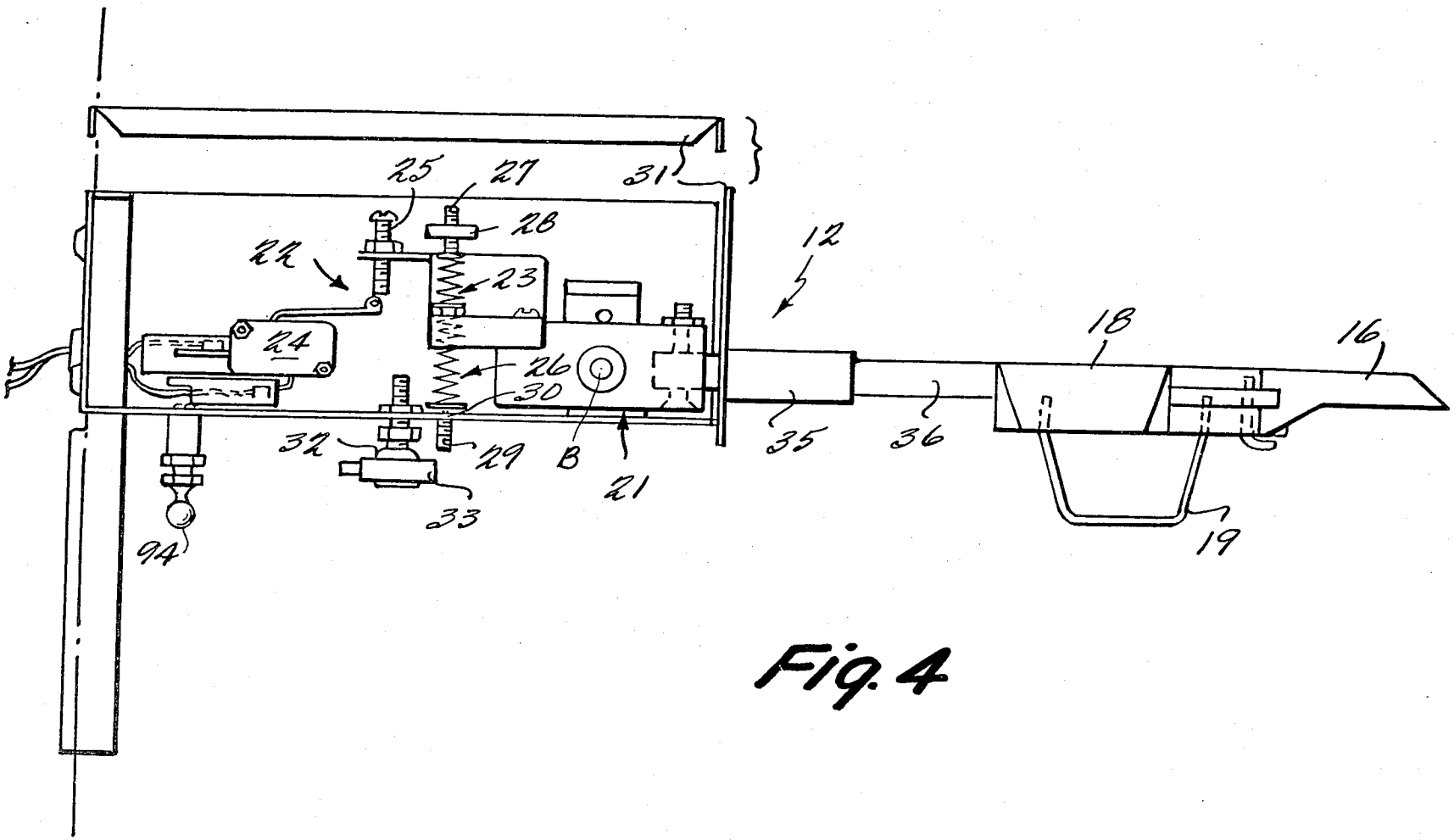
FIG. 4 is a side view, with portions cut away for clarity, of the container holding arm of FIG. 2.

An automatic vending machine for delivering containers (i.e., edible cones) having edible product therein, (i.e., soft ice cream, frozen yogurt) is shown schematically at 10 in FIG. 1. The machine includes a container discharge station 11 for discharging containers one at a time into operative association with an arm 12 pivotally mounted to the machine 10 for rotation about a first, generally vertical axis A—A (FIG. 4). The machine 10 also includes a container filling station 13 at which edible products is dispensed from a dispensing nozzle into the container automatically. The machine 10 also includes a delivery chamber 14 for receiving each product-filled container being vended, the consumer having access to the delivery chamber after the container filled with edible product is disposed within the chamber 14, and the arm 12 is removed from the chamber 14.

Figures 2, 11:
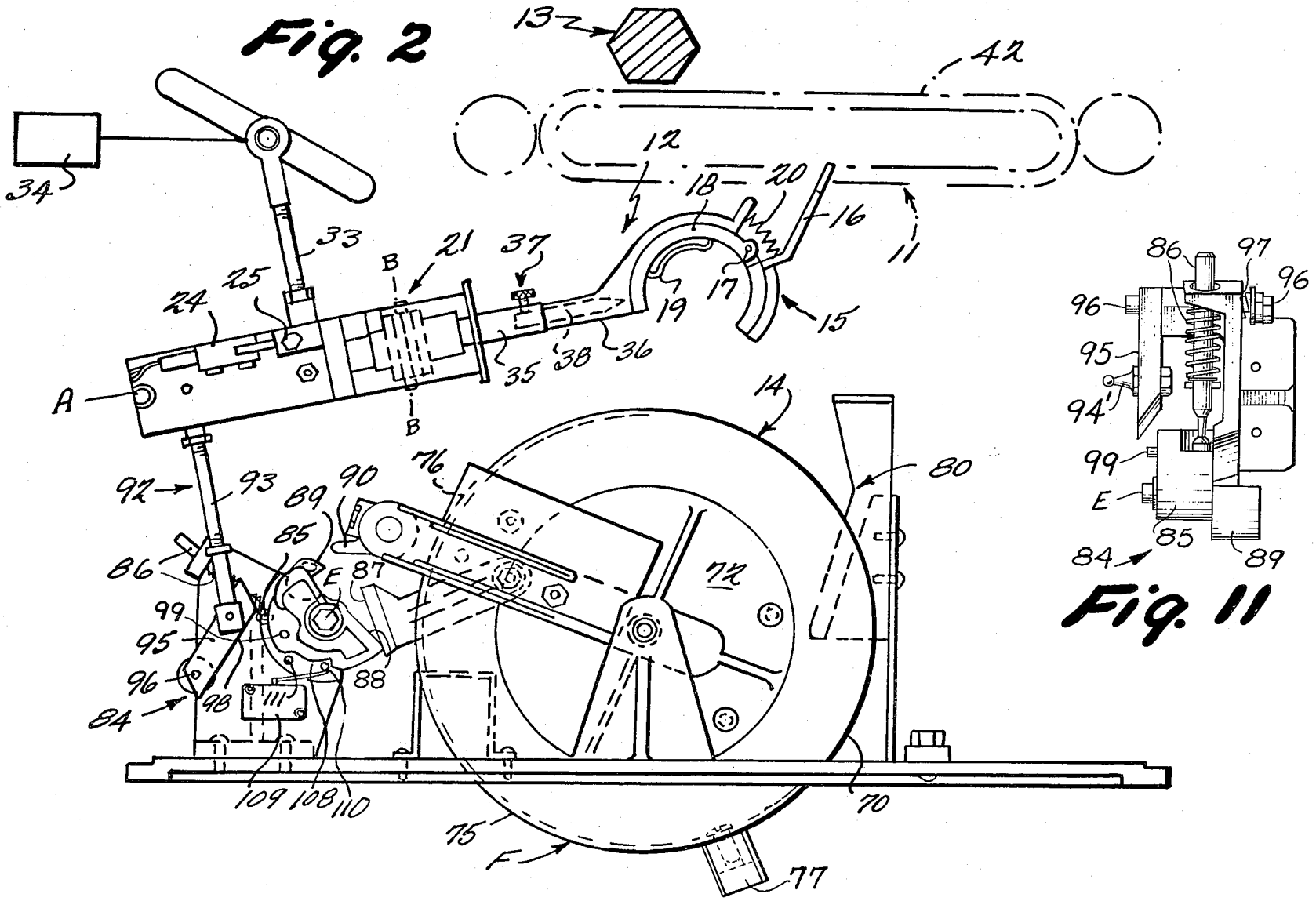
FIG. 2 is a top plan view, with portions cut away for clarity, showing a container holding arm, delivery chamber, and latching means.
FIG. 11 is an end detail view of the mechanical latching means of FIGS. 2 and 3.

As shown most clearly in FIGS. 2 and 4, the arm 12 has one end thereof having container-holding means 15 for receiving and holding containers adapted to have edible product delivered thereto, the means 15 including spring biased releasable clamping means including lever means 16 movable between first and second positions for alternatively clamping and griping a container therein. The clamping means 15 has an open top so that containers may be fed into operative association therewith from a position vertically above the means 15 without necessity of moving the lever means 16 against the spring bias. The lever means 16 is pivotally mounted at 17 to a main curved body portion 18 of the arm 12, the body portion 18 having a wire cone rest 19 associated therewith. A coil spring 20 or the like provides the bias for spring biasing lever means 16 so that the means 15 is normally in a position clampingly engaging a container.

The arm 12 also comprises means 21 for pivotally mounting the arm for rotation about a second, generally horizontal axis B—B, the means 21 including a collar and rod arrangement (See FIG. 4). Product weight responsive means 22 are also associated with the arm 12 for terminating delivery of product to a container at the container filling station 13 after a predetermined weight of product has been delivered to the container. The means 22 includes an adjustable first spring means 23 and in engagement with the arm 12 for biasing the arm container-holding means 15 and in an upward direction about the second pivot B—B. The means 22 also includes a microswitch 24, and microswitch actuating means 25 mounted to the arm 12 and movable against the bias of the first spring means 23 in response to product weight to actuate the microswitch 24. The position of the actuating means 25 relative to the arm 12 may be adjusted, as by providing the means 25 as a screw engageable a nut operatively connected to the arm 12.

The edible product dispensed according to the present invention normally is pressurized during dispensing—i.e., soft ice cream or machine-dispensed milk shakes and the like. In order to negate the effects of the delivery pressure on the weight-response of the weight responsive means 22, second adjustable spring means 26 are provided for biasing the arm 12 for rotation about the second pivot B—B in a direction opposite the direction in which the first spring 23 biases the arm 12. The first and second spring means 23, 26 may comprise coil springs mounted to screw rods 27, 29 respectively which are respectively engageable with interiorly threaded nuts 28, 30 to provide adjustment of the force exerted by the coil springs.

The spring means 23, 26 and the weight-responsive means 22, and the means 21 for pivotally mounting the arm 12 preferably are contained within a single housing 31, with a telescoping portion 35 of arm 12 extending horizontally outwardly from the housing 31, and the housing 31 mounted for pivotally movement about axis A—A. A ball joint 32 extends downwardly from the casing 31, and a lever 33 is mounted pivotally mounted thereto, the lever 33 operatively connected to a motorized power source for oscillation of the arm 12 about the axis A—A (see FIGS. 2 and 10). The connection between lever 33 and power source 34 may be any suitable connection such as shown in U.S. Pat. No. 3,413,052, and as shown in FIG. 10.

If desired, adjustment of the length of the arm 12 may be provided by utilizing telescoping rod sections 35, 36 to make up the arm exterior of the housing 31. An adjustment 37 may be provided which bears on a flaten portion of a pin 38 extending between the telescoping members 36, 35 to provide for adjustment of the effective lengths of the sections 35, 36. Any other suitable length adjusting means may also be utilized.

By utilizing the arm 12 with spring biasing and product weight-responsive means according to the present invention, product such as soft ice cream or the like may be readily dispensed accurately. Without utilization of product-weighting means, difficulties can some time result in the dispensing of the product since the density of the product can change significantly, and because of other particulars of the makeup thereof. Utilizing the structure shown in FIGS. 2 and 4, however, accurate dispensing of the product is possible.

Figure 7:
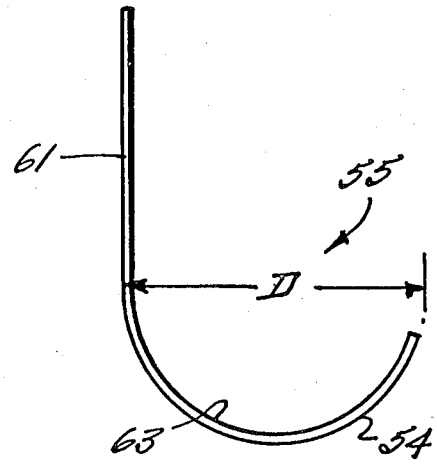
FIG. 7 is an end view of the cone chute of FIG. 6.
Figure 5:
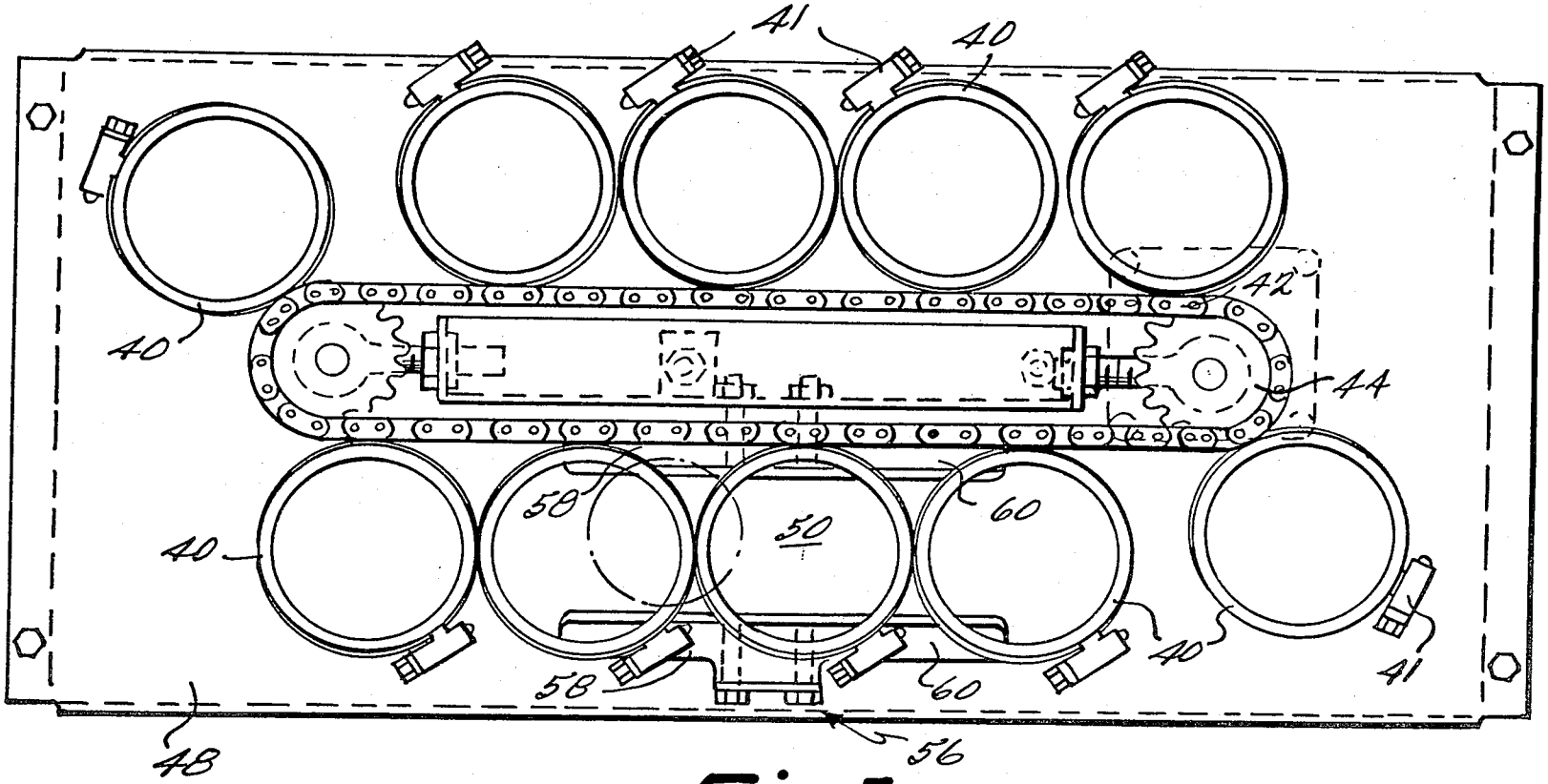
FIG. 5 is a top plan view of exemplary cone dispensing means.
Figure 6:
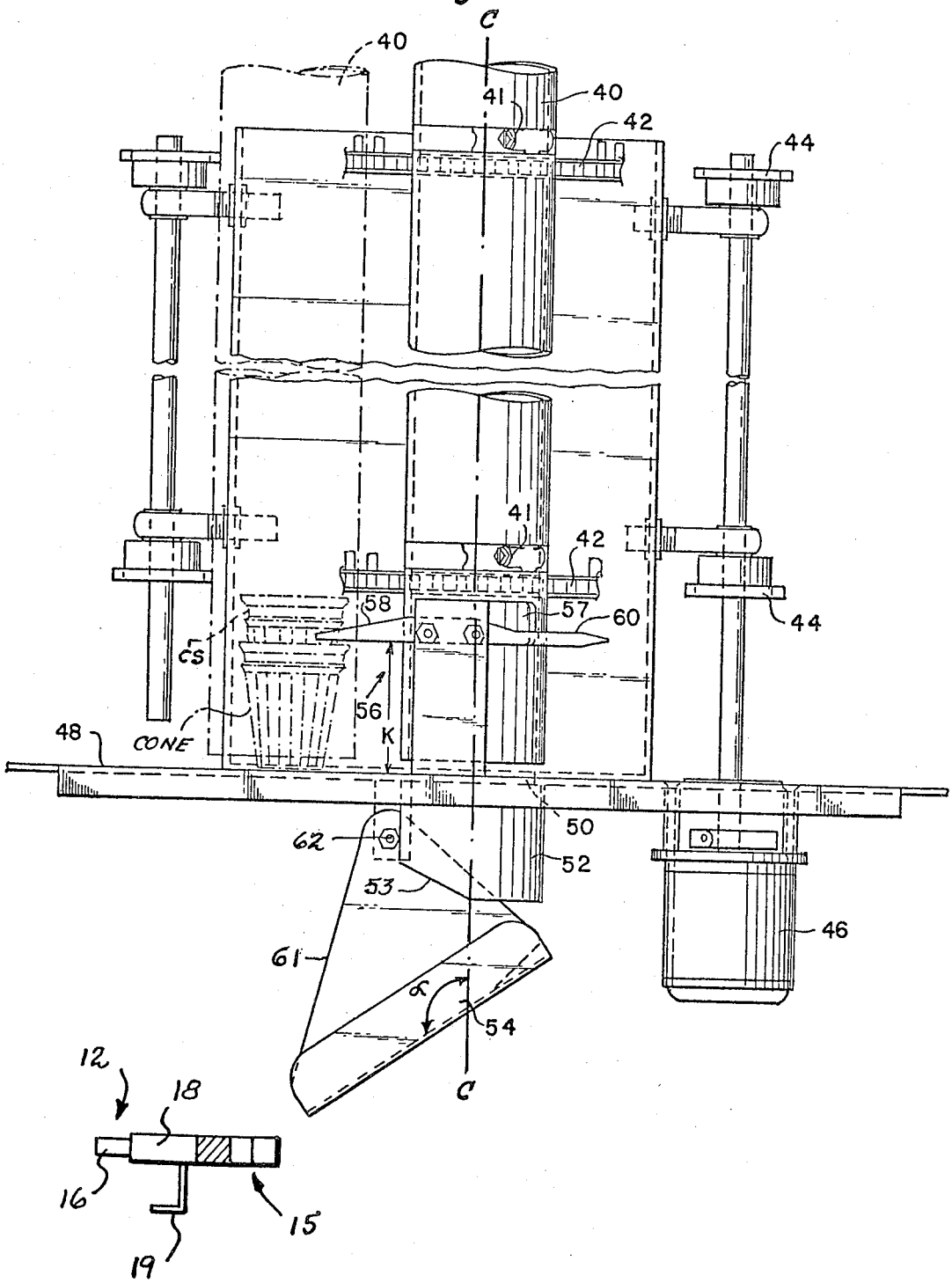
FIG. 6 is a side view, with portions cut away for clarity, of the structure of FIG. 5.

Means for automatically dispensing cones (or other similar containers) at a container discharge station 11, are shown in detail in FIGS. 5, 6 and 7.

A plurality of generally vertically upstanding clear plastic tubes 40 or the like are provided, connected by suitable means such as metallic bands 41 to suitable drive structures such as chains 42 driven by gears 44 and a motor 46. A stack of cones 10 is provided in each one of the tubes 40, and as the tubes 40 are revolved under power of the motor 46, the bottom cone in each stack engages the top of the plate 48 and slides therealong. An opening 50 is provided in the plate 48 in the path of the cylinders 40, with a guide tubular portion 52 extending downwardly from the plate 48 around the opening 50, and a cone guide chute 54 is disposed in operative relationship with the tube portion 52 to guide the path of a cone that drops through the opening 50 and to portion 52 to a product-filling area below the bottom termination of the chute 54. The chute 54 terminates just above arm 12, as shown in FIG. 6.

The cones are dispensed one at a time by the camming means 56. The camming means 56 includes two cam surfaces 58 disposed on either side of the pathway of the tubes 40, each tube 40 having a slit formed therein to allow penetration of the camming surface 58 thereinto. The camming surface 58 is disposed a distance K above the plate 48, the distance K being greater than the height of the container (cone) but being less than—at least at the leading edge thereof—the height of the slanted cam portion CS of the second cone in the stack. The relative movement of the cones in the stack in a tube 40 with respect to the camming surface 58 results in the camming surface 58 engaging the slanting portion 24 of the next-to-the-lowest cone in the stack and raising that cone (and the cones in the stack disposed thereabove) upwardly slightly and supporting it in the vertical direction while the lowest cone in the stack drops through the opening 50 in plate 48, and subsequently is guided by the chute 54 toward the dispensing arm 12. As the tube 40 continues relative movement with respect to the means 56, the formerly next-to-lowest cone in the stack—which is now the lowest cone in the stack—engages the lowering surface 60 (or rather the slanted portion 24 thereof engages the surface 60), to ultimately lower the lowest cone in the stack into engagement with the top of the plate 48. The cones in the next stack in the next tube 40 are simultaneously brought into operative engagement with the means 56 so that automatic one-at-a-time dispensing of the cones is continuous.

When edible cones are used, a sanitary inedible covering may be provided therefor, as shown in commonly-assigned co-pending Application Ser. No. 825,149, filed Aug. 16, 1977, now U.S. Pat. No. 4,136,800.

In order to insure that the containers will not be misaligned or inverted during dropping thereof through the opening 50, and will be positively guided into operative association with the arm clamping means 15, the guide means are provided as illustrated in FIGS. 6 and 7 in particular. The guide means includes the generally tubular member 52 and the chute 54 disposed vertically below the tubular member 52, the chute 54 having a generally open top 55 and having a primary container guiding portion 63 thereof extending downwardly from the tubular member 52 and disposed at an obtuse angle with respect to the axis C—C of the tubular member 52 (the axis C—C being generally vertical). The tubular member 52 has angled wall portions 53 thereof formed on the side of the member 52 axis from which the chute 54 extends downwardly at an obtuse angle α. The angle α—as shown in the drawings is about 124°. The chute container-guiding portion 63—as shown in FIG. 7—is semi-circular in cross-section, having a diameter D slightly greater than the greatest diameter of a container guided thereby. A bracket 61 is operatively connected to the bottom of the plate 48 by a screw and nut arrangement 62 or the like. The arm 12 clamping means 15 is disposed below the chute 54 as a continuation of the primary container-guiding surface 63 thereof.

Utilizing the cone dispensing structure of FIGS. 5 through 7 it is possible to accurately dispense cones or other similar containers one at a time from stacks to the arm 12 without dropping, misalignment or inversion of the containers during movement from the stacks into operative engagement with the arm 12.

Figure 3:
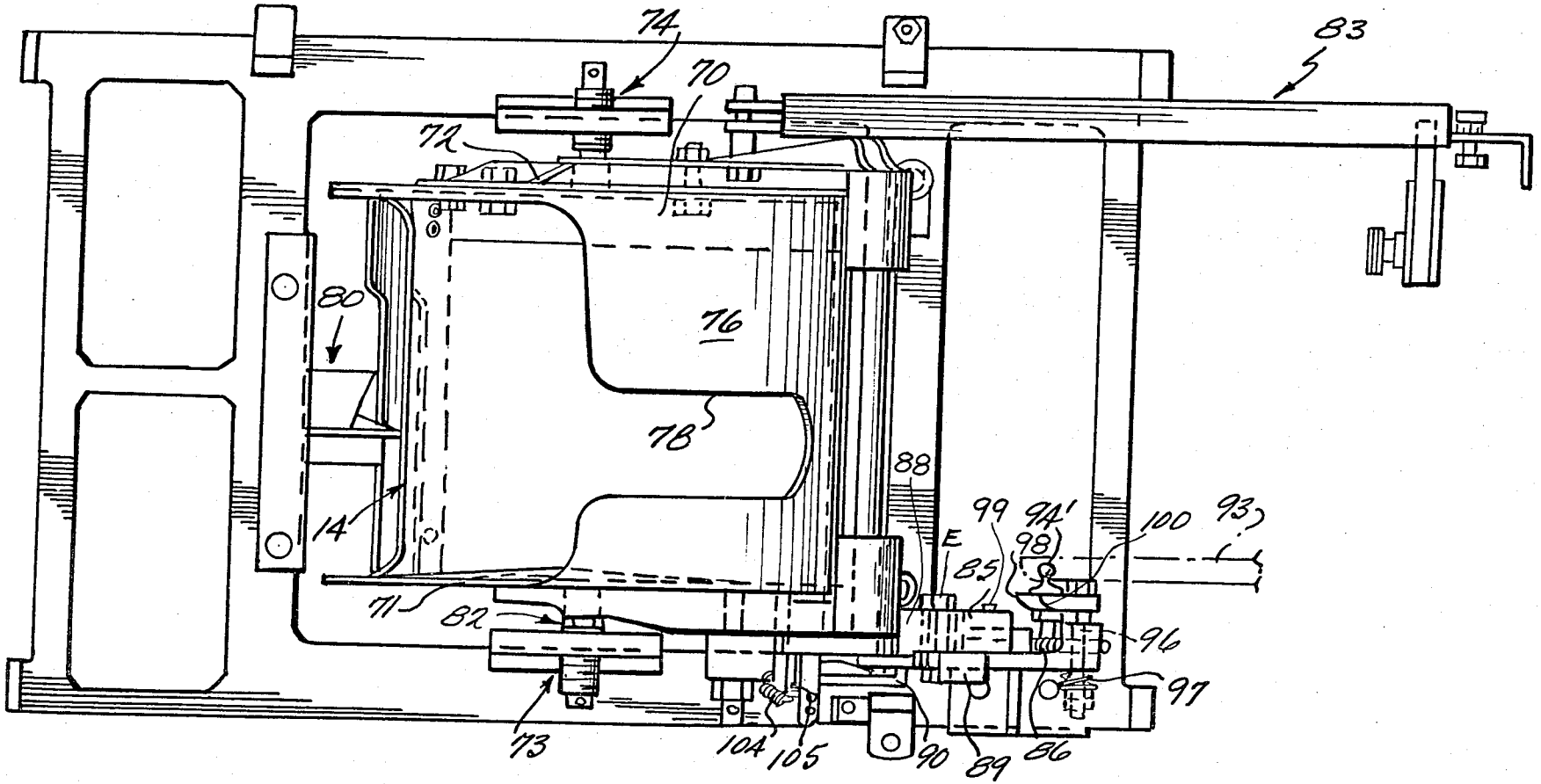
FIG. 3 is a side view of the view of the delivery chamber and latching means of FIG. 2.

The delivery chamber 14 for the machine 10 preferably comprises a cylinder 70 having a bottom disc 71 and a top disc 72. The bottom disc 71 comprises—along with suitable receiving pins such as shown in U.S. Pat. No. 3,413,052—receiving means in the delivery chamber 14 to receive each product filled container being vended after it is released from the container holding means 15. As shown most clearly in FIGS. 2 and 3, means 73, 74 are provided mounted with the disc 71, 72 for effecting adjustment of the vertical position of the cylinder 70. The front face of the cylinder 70 comprises a first door 75, a second door 76 being provided by a second part of the cylinder 70 and rotatable therewith. The first and second doors 75, 76 are alternatively opened and closed, the first door 75 blocking access to the delivery chamber 14 from exterior of the machine 10, and the second door 76 blocking access from the delivery chamber 14 to the arm 12 and the other interior components of the machine 10. A handle 77 is provided on the front face F of the cylinder 70 for effecting rotation thereof, and a slot 78 is formed in the door 76 to allow movement of the arm 12 into the chamber 14 to disposit a product-filled container on the receiving means 71. Abutment means 80 are provided as a ramp for engaging the lever means 16 when the container holding means 15 is within the delivery chamber 14, for moving the lever means 16 against the bias of spring 20 to release the container carried thereby, as more fully described in U.S. Pat. No. 3,413,052. A torsion spring 82 (see FIG. 3) is mounted in operative association with the cylinder 70 to return the cylinder to the position shown in FIG. 2 after release of the handle 77. Preferably, a dash pot 83 is provided for slowing the return movement of the cylinder 70 under the bias of spring 82 so that the consumer will not have his/her hand or fingers injured by the quick return of the cylinder 70.

The torsion spring may be eliminated if desired, and a pneumatic opener and closer may be provided as the element 83. The pneumatic opener and closer allows rapid opening movement of the door 75, but allows only slow closing thereof. Many suitable conventional structures are available for effecting this function.

Mechanical latching means 84 (see FIGS. 2, 3, and 11 in particular) are provided for latching the first door 75 in closed position until the arm item-holding means 15 has been completely withdrawn from the delivery chamber 14 after receipt of an item by delivery chamber 14. The latch means includes a latch member 85 and an over-center spring-biasing means 86 for holding the latch member 85 in either its latched or unlatched position until it is positively moved to the other position. The latch member 85 comprises a door-movement blocking portion 88 and a cam portion 89 disposed in a different plane than the door-movement blocking portion 88. The first door 75 (cylinder 70 axis) includes a blocking member 87 disposed in the same plane as the latch means door-movement blocking portion 88 and adapted to being engaged thereby, and means are provided associated with the first door 75 for resetting the latching means 84 to latch the first door 75 after opening movement thereof and removal of the item from the delivery chamber 14 so that the first door 75 is latched shut during the movement of the arm 12 from into and out of the delivery chamber 14.

The automatic resetting means includes a lever 90 that is movable into engagement with the flat surface of the cam portion 89 to rotate the latch member 85 in the counterclockwise direction about pivot E during closing movement of the first door 75 after opening thereof. The lever 90 is connected by a spring 104 to a pin 105 attached to the bottom of the cylinder 70, so that the lever 90 is moved over-center in response to pivitol movement of the cylinder 70. The mechanism 90 and cam 89 are preferably so positioned that it is necessary that the door 75 be opened more than one-half way before the latch member 85 is tripped back to latching position.

Rod means 92 operatively connected to the arm 12 and latch means 84 are also provided for effecting unlatching of the first door 75 in response to movement of the arm 12 so that the first door 75 is unlatched by the rod means 92 after movement of the arm 12 out of the delivery chamber 14. The rod means 92 includes a rod (which may be adjustable in length) 93 operatively pivotally connected at one end thereof to a ball joint 94 (see FIG. 4) associated with the arm 12, and pivotally connected at the other end thereof to a ball joint 94' associated with a lever 95. The lever is pivotally mounted for rotation about an axis by a pin 96 at one end thereof, the pin 96 also being movable against a spring bias from spring 97 in a direction generally parallel to the axis about which the lever 95 is pivotal. The lever 95 has cam means (slanted surface portion) 98 formed at the end thereof opposite the pivoted end thereof so that the lever 95 may be cammed over a latch projection 99 with which its cooperates, which latch projection 99 is mounted on the latch member 85. When the lever 95 is pivoted by the rod 93 in the clockwise direction as shown in FIG. 2, the cam means 98 engages the latch projection 99, and the lever is lifted upwardly—against the bias of spring 97—so that it is cammed out of the way of projection 99 and does not effect any movement of the latch member 85. However, once the lever 95 passes the latch projection 99, by movement of the rod 93 the surface 100 of the lever 95 positively abuts the latch projection 99, and rotates the latch member 85 clockwise about the pivot E as shown in FIG. 2, to thereby effect unlatching of the latch means 84, the portions 87, 88 moving out of interfering relationship with each other.

The latch member 85 further comprises cam surface means 108 (see FIGS. 2 and 9) for engaging an actuator 110 for a microswitch 109, the movement of the latch member 85 to the latching position effecting operation of the microswitch 109 to thereby energize the steping motor 46 which drives the gears 44 and chains 42 to move the next tube 40 into operative association with the opening 50, so that the next container is dropped into operative association with the arm 12. Switch means 109—as shown in FIG. 9—also may effect closing of a switch connecting motor 34 to power, so that motor 34 is not capable of energization unless the first door 75 has been relatched after opening and then closing thereof. A stop 111 may also be associated with the cam means 108 for providing a positive stop for the latch member 85 in its latching and unlatching positions, the positive stop 111 preventing damage to the overcenter spring means 86.

Operation of an exemplary structure according to the invention will now be described, with particular reference to FIGS. 8 through 10 which show schematics illustrating operation thereof. Operation of the machine 10 starts with the arm 12 at the container discharge position 11, with a cone or other container received by the clamping end 15 of the arm 12. A consumer placing a coin in the coin slot activates a coin responsive switching system 124, which in turn energizes the motor 34 to rotate the plate 34' (see FIG. 10) 90° to bring the arm 12 into position below the dispensing nozzle at the product dispensing station 13. The photo-electric assembly 115 (see FIG. 8) senses the movement of the arm 12 into a position underneath the dispensing head, which causes the relay 116 to be deactivated, closing switch 117 and therefore completing a circuit which effects energization of the dispensing head. Product is dispensed by the dispensing head until the predetermined weight of product desired has been dispensed, which is sensed by the switch means 24, and which may be adjusted by adjusting the tension on the springs 23, 26 and the position of the operator 25. When switch means 24 is actuated, the supply of power to the dispensing head is cut off and no more product is dispensed, and simultaneously the switch 119 is closed momentarily, the circuitry 120 maintaining the supply of electrical energy to the motor 34 once the momentary completion switch 119 is closed so that the plate 34' drives the arm 33 from the station 13 to the delivery chamber 14, and then back to the original position 11 wherein the arm is out of the delivery chamber 14 and in operative association with the container dispensing means station 11. A cam 122 may be provided associated with the plate 34' for actuating the switch 121 of the circuit means 120 to terminate energization of the motor 34 once the plate 34' has returned to its original position (see FIG. 10).

Movement of the arm 12 out of the delivery chamber 14 effects movement of the lever 95 into abutting engagement with the latch 99, which pivots the latch member 85 clockwise at about the pivot E (see FIG. 2) to provide unlatching of the first door 75. Since the first door 75 is unlatched, the consumer may now grasp the handle 77, and rotate the door 75 clockwise (as shown in FIG. 2) so that access to the delivery chamber 14 is provided, the second door 76 blocking entry from the delivery chamber 14 to the interior of the machine 10, such as access to the arm 12. After the consumer releases the handle 77, it moves under the bias of torsion spring 82 back to its original position (FIG. 2) wherein the door 75 is closed, the dash pot 83 slowing the return movement. During the return movement, the lever 90 is moved into operative association with the cam portion 89 of the latch member 85, so that the latch 85 is rotated counterclockwise about the pivot E, (see FIG. 2) back into latching engagement with the first door 75.

During movement of the arm 12 into the delivery chamber 14, the abutment means 80 pivots the lever 16 against the bias of spring 20 to release the product-filled container so that it is deposited on the disc 71. The rotation of the latch member 85 back to the latching position effects movement of the cam surface 108 (see FIG. 9 in particular) to actuate the plunger 110 to operate the switch means 109, which is connected by the circuitry 112 to the stepping motor 46, which then rotates the next tube 40 into position above the opening 50 so that the next cone drops down through the chute 54 into clamping engagement by the arm 12. The procedure may then be repeated by deposit of another coin into the coin receiving slot.

It will thus be seen that according to the present invention an automatic vending machine has been provided which automatically delivers containers having edible product therein, such as cones filled with soft ice cream. While the invention has been herein shown and described in what is presently conceived to be the most preferred and practical embodiment thereof, it will be apparent to those of ordinary skill in the art that many modifications may be made thereof within the scope of the invention, which scope is to be accorded the broadest interpretation of the apended claims so as to encompass all equivalent structures and devices.

What is claimed is:

1. An automatic vending machine for delivering containers having edible product therein comprising a container discharge station for discharging containers one at a time into operative association with an arm pivotally mounted to the machine for rotation about a first, generally vertical axis; said arm having an end thereof having container-holding means for receiving and holding containers adapted to have edible product delivered thereto and to be vended, and including spring biased releasable clamping means including lever means movable between a first and second position for releasing said clamping means; a container filling station for filling a container held by said container-holding means with edible product; a delivery chamber having first and second alternately opened and closed first and second doors, respectively, said first door blocking access to said delivery chamber from exterior of the machine, and said second door blocking access from said delivery chamber to said arm; abutment means positioned so that said lever means is engageable with said abutment means when said container holding means is within said delivery chamber; and receiving means so positioned in said delivery chamber to receive each product filled container being vended after it is released from said container-holding means; wherein the improvement comprises:

means pivotally mounting said arm for rotation about a second, generally horizontal axis and product weight-responsive means associated with said arm for terminating delivery of product to a container at said container filling station after a predetermined weight of product has been delivered to the container at said container filling station;

mechanical latching means for latching said first door in closed position until said arm container-holding means has been completely withdrawn from said delivery chamber after receipt of a product-filled container by said delivery chamber, and rod means operatively connected to said arm and said latch means for effecting unlatching of said first door in response to movement of said arm, so that said first door is unlatched by said rod means after movement of said arm out of said delivery chamber; and wherein said first door includes means associated therewith for resetting said latching means to latch said first door after opening movement of said first door and removal of the container from said delivery chamber so that said first door is latched shut during movement of said arm from the container discharge station to the container filling station to the delivery chamber.

2. A machine as recited in claim 1 wherein said improvement further comprises said product weight-responsive means including adjustable first spring means in engagement with said arm for biasing said arm container-holding means end in an upward direction about said second pivot; a microswitch; and microswitch actuating means mounted to said arm and movable against the bias of said first spring means in response to product-weight to actuate said microswitch.

3. A machine as recited in claim 1 wherein said rod means includes a rod operatively pivotally connected at one end thereof to said arm, and pivotally connected at the other end thereof to a lever; and wherein said lever is pivotally mounted for rotation about an axis at one end thereof to a stationary member, and is also movable against a spring bias in a direction generally parallel to the axis about which said lever is pivotal; said latch means including a latch projection adapted to be abutted by said lever; and said lever having cam means formed at the end thereof opposite the pivoted end thereof so that said lever may be cammed over said latch projection during movement of said arm into said delivery chamber so that said lever will positively abut said latch projection to effect unlatching movement of said latch during movement of said arm out of said delivery chamber.

4. A machine as recited in claim 3 wherein said latch means comprises a cam portion and a door movement blocking portion, said cam portion being disposed in a different plane than said door-movement blocking portion, and wherein said first door includes a blocking member disposed in the same plane as said latch means door-movement blocking portion and adapted to be engaged thereby, and wherein said means for resetting said latching means comprises means for effecting engagement of said latch means cam portion for effecting movement thereof so that said door-movement blocking portion moves into blocking engagement with said door blocking member.

5. A machine as recited in claim 4 wherein said latch means includes overcenter spring biasing means to hold said door-movement blocking portion in the position to which it is moved by said arm or said door until moved to its other position by said door or said arm.

6. A machine as recited in claim 5 wherein said delivery chamber has a front face and said first door comprises part of a cylinder rotatable about a vertical axis, and wherein said second door comprises a second part of said cylinder and rotatable therewith and wherein a bottom floor of said cylinder includes a disc comprising said receiving means.

7. A machine as recited in claim 4 further comprising a latch-responsive microswitch and means for operating said microswitch in response to movement of said latch means between latching and unlatching positions.

8. A machine as recited in claim 1 wherein the edible product dispensed is pressurized, and wherein said product-weight responsive means comprises first and second spring means, said first spring means in engagement with said arm for biasing said arm container-holding means end in an upward direction about said second pivot and wherein said second spring means engages said arm for biasing said arm for rotation about said second pivot in a direction opposite the direction in which said first spring means biases said arm so that the effects of the delivery of pressurized product on weight-response of said weight responsive means are negated.

9. An automatic vending machine for delivering items to be vended comprising an arm pivotally mounted to the machine for rotation about a generally vertical axis, said arm having an end thereof having item-holding means for receiving and holding items to be vended, and including spring biased releasable clamping means including lever means movable between a first and second position for releasing said clamping means; a delivery chamber having first and second alternately open and closed first and second doors, respectively, said first door blocking access to said delivery chamber from exterior of the machine and said second door blocking access from said delivery chamber to said arm; abutment means positioned so that said lever means is engageable with said abutment means when said item-holding means is within said delivery chamber; and receiving means so positioned in said delivery chamber to receive items being vended after release from said item-holding means; wherein the improvement comprises:

mechanical latching means for latching said first door in closed position until said arm item-holding means has been completely withdrawn from said delivery chamber after receipt of an item by said delivery chamber; and rod means operatively connected to said arm and said latch means for effecting unlatching of said first door in response to movement of said arm so that said first door is unlatched by said rod means after movement of said arm out of said delivery chamber; and wherein said first door includes means associated therewith for resetting said latching means to latch said first door after opening movement of said first door, at least past one-half open position, and removal of the item from said delivery chamber so that said first door is latched shut during movement of said arm into and out of said delivery chamber.

10. A machine as recited in claim 9 wherein said latch means comprises a latch member and an overcenter spring-biasing means for holding said latch member in either its latched or unlatched position until positively moved to the other position.

11. A machine as recited in claim 10 wherein said rod means includes a rod operatively pivotally connected at one end thereof to said arm, and pivotally connected at the other end thereof to a lever; and wherein said lever is pivotally mounted for rotation about an axis at one end thereof to a stationary member, and is also movable against a spring bias in a direction generally parallel to the axis about which said lever is pivotal; said latch means including a latch projection on said latch member adapted to be abutted by said lever; and said lever having cam means formed at the end thereof opposite the pivoted end thereof, so that said lever may be cammed over said latch projection during movement of said arm into said delivery chamber so that said lever will positively abut said latch projection to effect unlatching movement of said latch during movement of said arm out of said delivery chamber.

12. A machine as recited in claim 10 wherein said latch member comprises a cam portion and a door-movement blocking portion, said cam portion being disposed in a different plane than said door-movement blocking portion, and wherein said first door includes a blocking member disposed in the same plane as said latch means door-movement blocking portion and adapted to be engaged thereby, and wherein said means for resetting said latching means comprises means for effecting engagement of said latch means cam portion for effecting movement thereof so that said door-movement blocking portion moves into blocking engagement with said door blocking member.

13. A machine as recited in claim 10 further comprising a latch-responsive microswitch and means for operating said microswitch in response to movement of said latch means between latching and unlatching positions.

14. A machine as recited in claim 9 wherein said delivery chamber has a front face and said first door comprises part of a cylinder rotatable about a vertical axis and wherein said second door comprises a second part of said cylinder and rotatable therewith, and wherein a bottom floor of said cylinder includes a disc comprising said receiving means.

15. A machine as recited in claim 9 further comprising pneumatic closer means for allowing quick opening of said first door but insuring slow closing thereof.

16. A machine as recited in claim 9 further comprising switch means responsive to movement of said latch means to prevent further movement of said arm until said first door has been relatched after opening of said first door.

* * * * *